US012227339B2

(12) United States Patent
Lake et al.

(10) Patent No.: US 12,227,339 B2
(45) Date of Patent: Feb. 18, 2025

(54) SPLASH-RESISTANT LID FOR BEVERAGE CONTAINER

(71) Applicant: Pacific Market International, LLC, Seattle, WA (US)

(72) Inventors: Stephen James Lake, Bremerton, WA (US); Lovina Hsin-I Hua, Bellevue, WA (US); Ernest Gomez, III, Las Vegas, NV (US)

(73) Assignee: Pacific Market International, LLC, Seattle, WA (US)

( * ) Notice: Subject to any disclaimer, the term of this patent is extended or adjusted under 35 U.S.C. 154(b) by 0 days.

(21) Appl. No.: 17/984,012

(22) Filed: Nov. 9, 2022

(65) Prior Publication Data

US 2024/0051715 A1 Feb. 15, 2024

Related U.S. Application Data

(60) Provisional application No. 63/371,464, filed on Aug. 15, 2022.

(51) Int. Cl.
*B65D 47/04* (2006.01)

(52) U.S. Cl.
CPC .... *B65D 47/04* (2013.01); *B65D 2543/00046* (2013.01); *B65D 2543/00092* (2013.01); *B65D 2543/00231* (2013.01); *B65D 2543/00518* (2013.01)

(58) Field of Classification Search
CPC ..... B65D 47/04; B65D 47/043; B65D 2543/00046; A47G 19/2272
USPC ..... 220/719
See application file for complete search history.

(56) References Cited

U.S. PATENT DOCUMENTS

| | | | | |
|---|---|---|---|---|
| 8,453,870 | B2 * | 6/2013 | Berg | A47G 19/2272 215/311 |
| 9,241,588 | B2 * | 1/2016 | Dunn | A47G 19/2272 |
| 11,224,301 | B2 | 1/2022 | Delgado Carmona | |
| 11,241,110 | B2 * | 2/2022 | Cudworth | A47G 19/2272 |
| 2011/0186573 | A1 * | 8/2011 | Tardif | B65D 41/02 220/260 |
| 2017/0275062 | A1 | 9/2017 | Cudworth et al. | |
| 2018/0194524 | A1 | 7/2018 | Chalermwinsuekun | |

FOREIGN PATENT DOCUMENTS

WO 2011/020501 2/2011

OTHER PUBLICATIONS

PCT International Search Report and Written Opinion in International Application PCT/US2023/072210, mailed Nov. 7, 2023, 13 pages.

* cited by examiner

*Primary Examiner* — Jeffrey R Allen
(74) *Attorney, Agent, or Firm* — Merchant and Gould, PC

(57) ABSTRACT

A container lid including: a lid body which includes a flared perimeter wall, an inner structure, and a perimeter well. The inner structure defines a central throat. The perimeter well defines a plurality of openings disposed around the central throat. A lid body seal is disposed about the lid body. A lid upper includes: a lid base and a lid roof secured to the lid base. The lid base is lockably received in the central throat. The lid roof at least partially covers the perimeter well when the lid base is lockably secured in the central throat.

10 Claims, 9 Drawing Sheets

SPLASH-RESISTANT LID FOR BEVERAGE CONTAINER

CROSS-REFERENCE TO RELATED APPLICATIONS

This application claims priority to and the benefit of U.S. Provisional Application No. 63/371,464, filed Aug. 15, 2022, and which is incorporated by reference herein in its entirety.

BACKGROUND

A beverage container often has a lid with an opening so that liquid contained therein may exit the container. This opening may be always open (e.g., not have a closable cover) so that a user can more easily drink from the container. The opening being always open, however, may allow the liquid contained therein to splash out through the lid when the container is being moved. Additionally, the lid of the beverage container often needs to be cleaned between uses. Lids for containers, however, are known to have hard to reach surfaces and/or areas that are otherwise difficult to clean.

SUMMARY

In an aspect, the technology relates to a container lid including: a lid body which includes a flared perimeter wall, an inner structure, and a perimeter well, wherein the inner structure defines a central throat, and wherein the perimeter well defines a plurality of openings disposed around the central throat; a lid body seal disposed about the lid body; and a lid upper including: a lid base; and a lid roof secured to the lid base, wherein the lid base is lockably received in the central throat, wherein when the lid base is lockably secured in the central throat, the lid roof at least partially covers the perimeter well. In an example, the central throat defines a plurality of locking channels, and wherein the lid base includes a plurality of bayonets extending into the plurality of locking channels when the lid base is lockably secured in the central throat. In another example, the container lid further includes a thumbturn extending from a bottom of the lid base. In yet another example, a bottom surface of the perimeter well pitches downward from the inner structure towards the flared perimeter wall. In still another example, the plurality of openings are defined by the perimeter well proximate a lowermost extent of the perimeter well.

In another example of the above aspect, the lid body further includes a shelf projecting inward from the flared perimeter wall towards the perimeter well. In another example, an underside of the lid roof is concave. In yet another example, an apex of the lid roof is disposed below an upper extent of the lid body. In still another example, the lid base is rotatably secured in the central throat.

In another aspect, the technology relates to a container lid including: a lid body including: a substantially cylindrical outer side wall having a first end and an opposite second end, the first end and the second end defining a longitudinal axis; a throat disposed within the outer side wall and spaced apart therefrom; and a well wall extending between the outer side wall at the second end and the throat, the well wall at least partially defining a plurality of openings spaced circumferentially around the longitudinal axis; and a lid upper configured to be releasably secured to the lid body, the lid upper including: a lid base configured to lockably mate with the throat; and a lid roof coupled to the lid base, the lid roof having a perimeter diameter, wherein when the lid base is secured within the throat, the perimeter diameter is such that the lid roof at least partially covers the plurality of openings. In an example, the lid upper further includes a gasket disposed at least partially between the lid base and the lid roof. In another example, the lid base lockably mates with the throat via a bayonet connection. In yet another example, the lid base includes one or more bayonets and the throat includes one or more corresponding locking channels. In still another example, the lid upper is at least partially rotatable around the longitudinal axis to lock the bayonet connection.

In another example of the above aspect, the outer side wall includes an inner shelf disposed between the first end and the second end, the inner shelf disposed at least partially underneath the lid roof when the lid upper is secured to the lid body. In an example, the lid roof is separated from the inner shelf by a gap, the gap fully extending circumferentially around the longitudinal axis. In another example, the throat is spaced from the second end of the outer side wall such that an underside surface of the well wall is concave. In yet another example, when the lid upper is secured to the lid body, the lid roof is spaced from the well wall such that a splash chamber is defined thereby, the splash chamber fully extends circumferentially around the longitudinal axis.

In another aspect, the technology relates to a beverage container including: a container body; and a container lid, the container lid configured to removable couple to the container body, the container lid including: a lid body having a flared perimeter wall, a central throat disposed within the flared perimeter wall, and a perimeter well extending between the flared perimeter wall and the central throat, the perimeter well at least partially defining a plurality of openings disposed around the central throat; a seal disposed around an exterior of the lid body, the seal configured to engage with the container body; and a lid upper having a lid base and a lid roof, the lid upper configured to releasably secure to the lid body such that the lid roof at least partially covers the perimeter well, wherein when the lid upper is secured to the lid body, the lid roof is spaced from the perimeter well such that a splash chamber is defined, wherein a flow path within the container lid is defined through the plurality of openings and the splash chamber.

DETAILED DESCRIPTION

Figure 1:
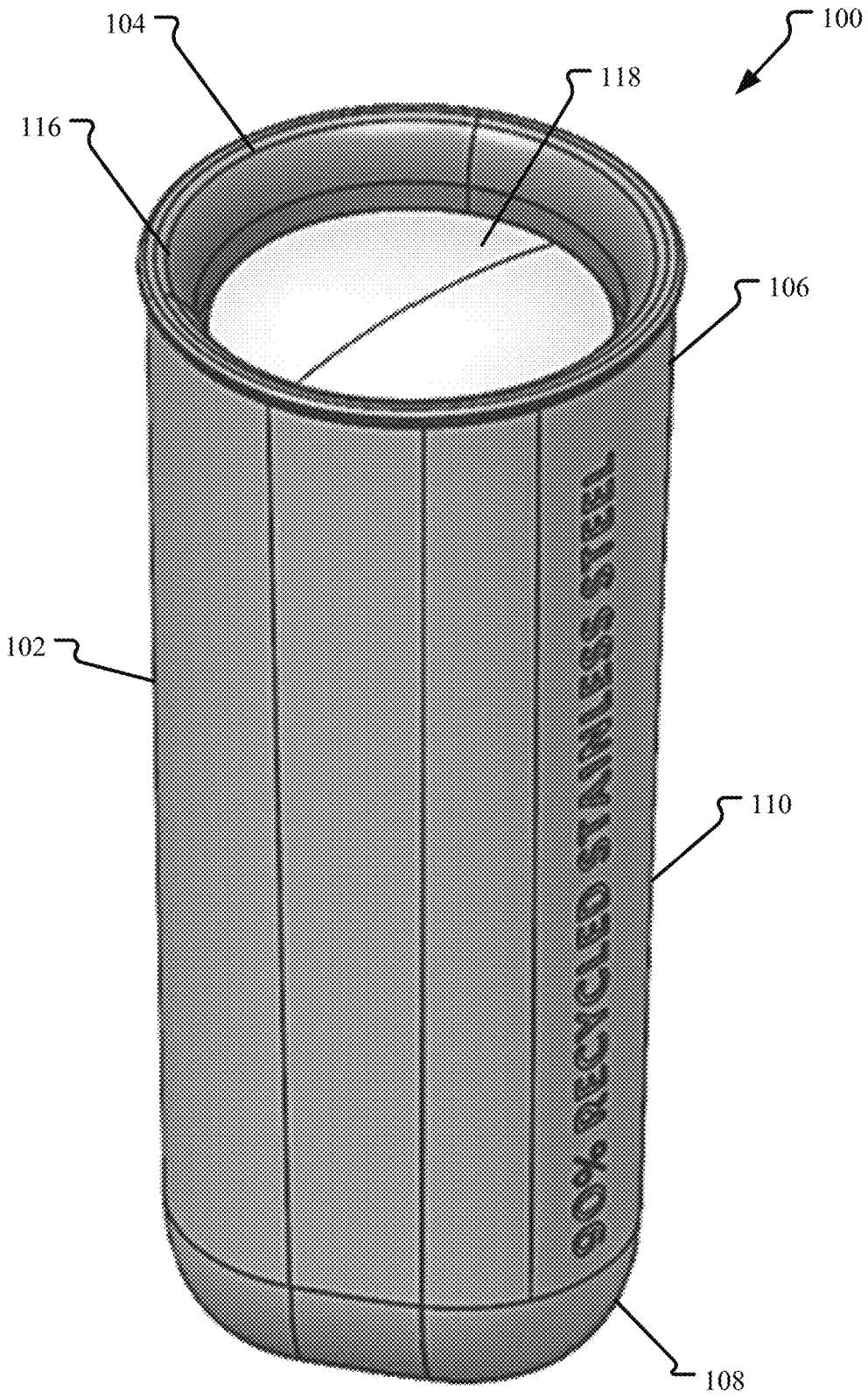
FIG. 1 illustrates a perspective view of an exemplary container having a container body and a container lid.

A lid for a beverage container (e.g., a so-called "travel mug") is described herein. The container lid is structured so as to resist liquids contained therein from splashing through the lid during movement of the container. The lid includes a lid body that is sealingly secured to a container body with a perimeter seal, such as a silicone seal. The lid body includes a perimeter wall that flares outward so as to be substantially flush with an outer perimeter of the container body. In other examples, the perimeter wall may extend slightly beyond or significantly beyond the outer perimeter of the container body. This may assist in removal of the lid from the container body and may help guide liquid within the container into a user's mouth during drinking (e.g., by letting the user position her bottom lip below an outermost rim of the flared perimeter wall).

The lid body is structured so as to form a perimeter well adjacent the flared perimeter wall. The perimeter well is disposed around an inner structure. The perimeter well includes structural features that allow for the free flow of liquid during drinking, but that resist the ejection of liquid therethrough during container movement. The depicted configuration includes a number of these structural features, but any lesser number of structural features may be combined as required or desired for a particular application, so as to prevent splashing.

For example, an underside of the lid (e.g., a surface facing the interior of the container body) pitches upward from an outermost extent proximate the flared perimeter wall. Thus, the majority of liquid that is forced upward along the inner wall of the container body due to container movement impact the underside of the lid and are deflected upward and inward, within the container body.

A bottom surface of the perimeter well (opposite the underside described above) pitches downward as the bottom surface approaches the flared outer wall, such that a lowermost extent is adjacent the flared perimeter wall. As this lowermost extent, the perimeter well defines a plurality of openings through which liquid may pass during drinking. As these openings are located at a lowermost extent, liquid disposed therein (due to drinking or inadvertent liquid movement through the openings due to container movement) will drain from the perimeter well and back into the container body interior.

Liquid that moves inadvertently through the openings (e.g., due to container movement) may eject upward through the openings into the perimeter well with significant speed or force. Such liquid may contact an underside of a lid roof and be deflected back towards the openings. In the depicted configuration, the underside of the lid roof is substantially convex, which would direct ejected liquid inward and away from a gap between the flared perimeter wall and the lid roof. Such deflected liquid may contact the inner structure and drain downward in the perimeter well, so as to drain back through the plurality of openings.

The depicted configuration also includes a shelf that projects inwardly from the flared perimeter wall. This shelf defines an outermost extent of the perimeter well so as to be disposed below the lid roof. Thus, liquids that eject through the openings upwardly with particular force will impact the lid roof. In the absence of this shelf, ejected liquid might otherwise travel vertically along the flared perimeter wall and out of the gap between the flared perimeter wall and the lid roof.

Thus, the structure of the perimeter well, including one or more of the above features, helps prevent liquid within the container from splashing out of the container during movement thereof. The perimeter well presents a convoluted flow path that may interrupt movement of liquid therethrough so as to prevent splashing. This convoluted flow path, however, can be difficult to clean. As such, the lid depicted herein includes additional features that allow the perimeter well to be easily accessed for cleaning, e.g., at least one removable component, such as a lid upper, may be included.

The lid upper may be manufactured of one or more parts and is removably secured to the lid body. In examples, the lid upper may be secured to the internal structure of the lid body. For example, the inner structure may include a throat, receiver, or other feature that may enable securement of the lid upper thereto. In an example, the throat may include a threaded receiver that may threadably mate with a base of the lid upper, such that the lid upper may be secured to lid body. For such a configuration, it may be desirable to include a thumbturn or other feature that may be gripped to help ensure a tight connection between the lid upper and the lid body. Another example of a locking element is depicted in the figures included herewith. In the figures, the inner structure defines a throat that includes a number of locking channels. Bayonets extend from an outer portion of lid base and may be inserted into the locking channels. Thereafter, the lid body may be rotated, for example, by a user rotating a thumbturn or other grippable element, so as to lock the lid base in place. In the depicted example, the lid upper is manufactured in two parts for ease of manufacturing, although a unitary lid upper may also be used.

Figure 2:
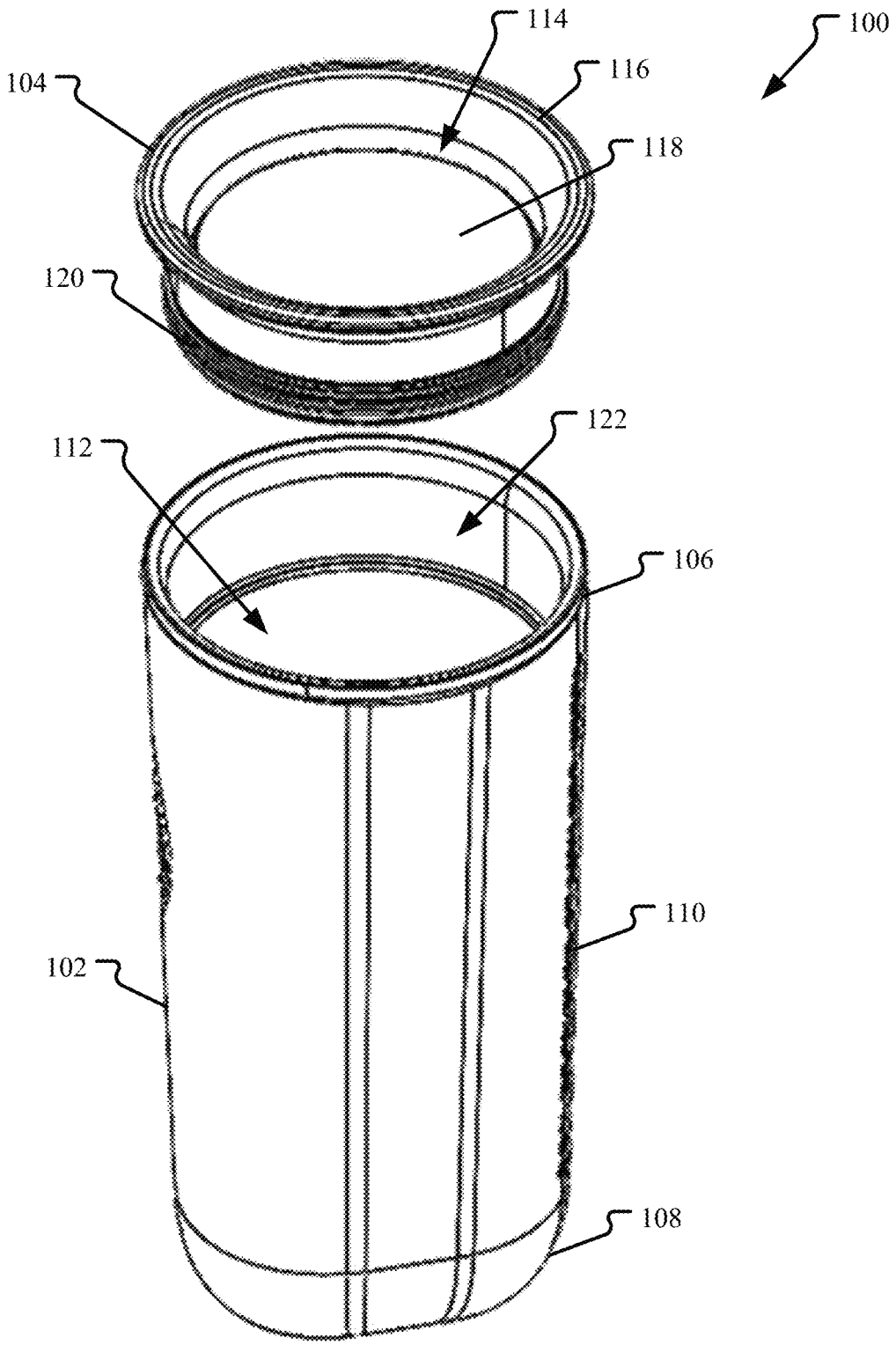
FIG. 2 illustrates a perspective view of the container lid decoupled from the container body of the container shown in FIG. 1.

FIG. 1 illustrates a perspective view of an exemplary container 100 having a container body 102 and a container lid 104. FIG. 2 illustrates a perspective view of the container lid 104 decoupled from the container body 102 of the container 100. Referring concurrently to FIGS. 1 and 2, the container 100 is illustrated as a drinking tumbler, but may alternatively take the form of a glass, mug, cup, goblet, stein, tankard, vessel, beaker, drinkware, beverageware, food container, or other vessel for holding liquid beverages or food for consumption. While the container 100 is described as being for liquids, the container 100 may be used for containing any other substances, materials, or items as required or desired.

The container body 102 has an upper end portion 106, an opposite lower end portion 108, and a middle portion 110 extending therebetween. The container body 102 defines an interior chamber 112 configured to hold liquids therein. The upper end portion 106 is open for access to the interior chamber 112 and the lower end portion 108 is enclosed. The interior chamber 112 extends from the upper end portion 106 into the middle portion 110 and towards the lower end portion 108. In the example, the container body 102 is substantially cylindrical in shape. In other examples, the container body 102 may have a downwardly tapered profile with the upper end portion 106 larger in diameter than the lower end portion 108. As illustrated, the container body 102 does not include a handle. In other aspects, the container body may include one or more handles as required or desired. The container body 102 may be formed from stainless steel. In other aspects, the container body 102 can be formed from glass, ceramics, plastics, etc., or combinations thereof. The container body 102 may also be manufactured so as to provide insulation for the liquid contained therein from a surrounding environment.

The container lid 104 is configured to removably couple to the container body 102. The container lid 104 defines one or more liquid flow paths 114 for liquid to be dispensed from the container body 102 when the lid 104 is coupled thereto. In the example, the lid 104 includes a lid body 116 and a lid upper 118 that are configured to be releasably secured to one another to facilitate cleaning. The liquid flow path 114 may be defined at least partially between the lid body 116 and the lid upper 118. The lid 104 includes a seal 120 that is configured to engage with an inner surface 122 of the container body 102 in a press fit connection so as to form a seal between the lid 104 and the container body 102 and force liquid contained therein to flow through the liquid flow path 114. In an aspect, the seal 120 may be a silicone seal. In other examples, the lid 104 may threadingly engage with the container body 102 as required or desired.

Figure 3:
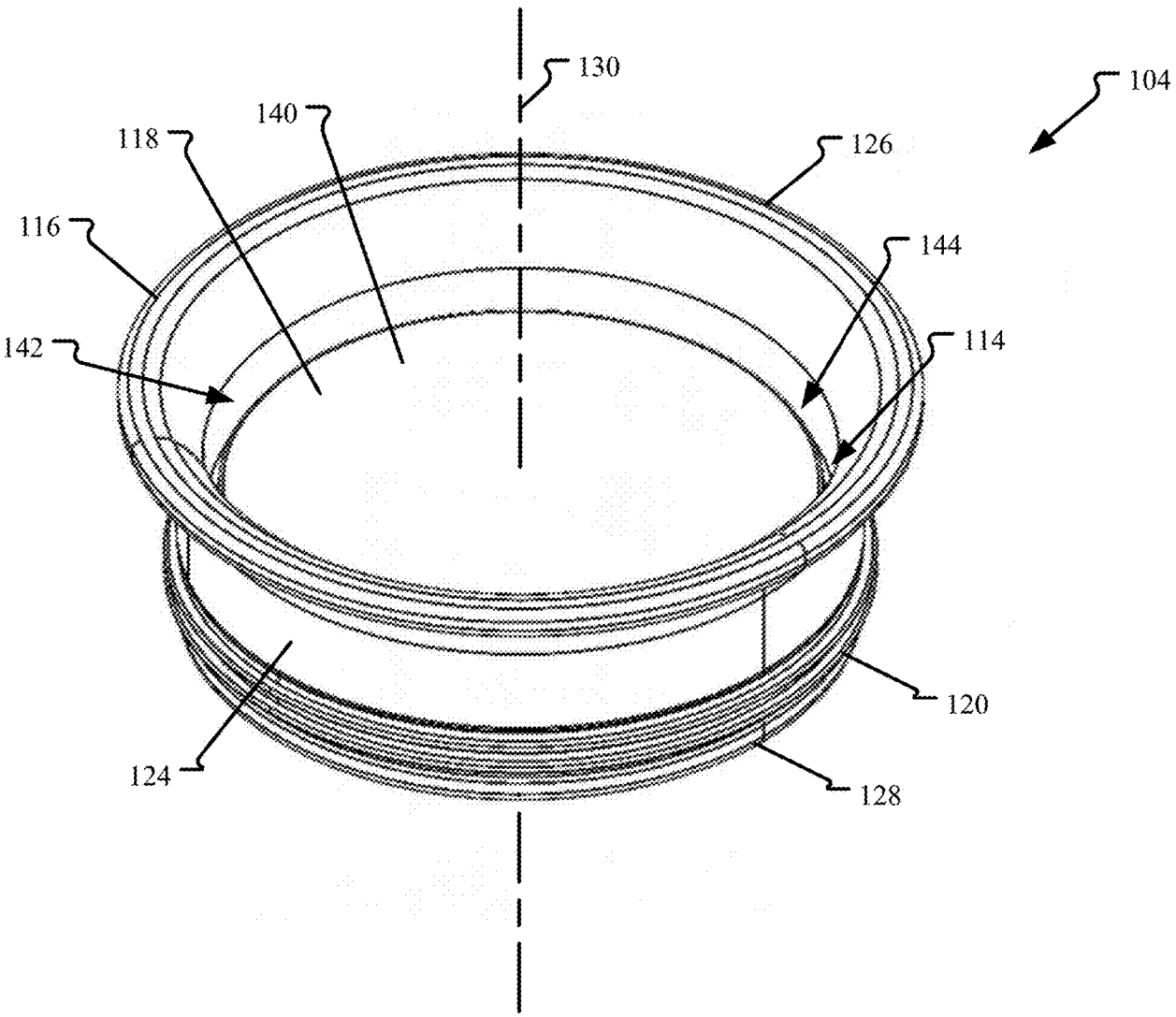
FIG. 3 illustrates a top perspective view of the container lid shown in FIGS. 1 and 2.
Figure 4:
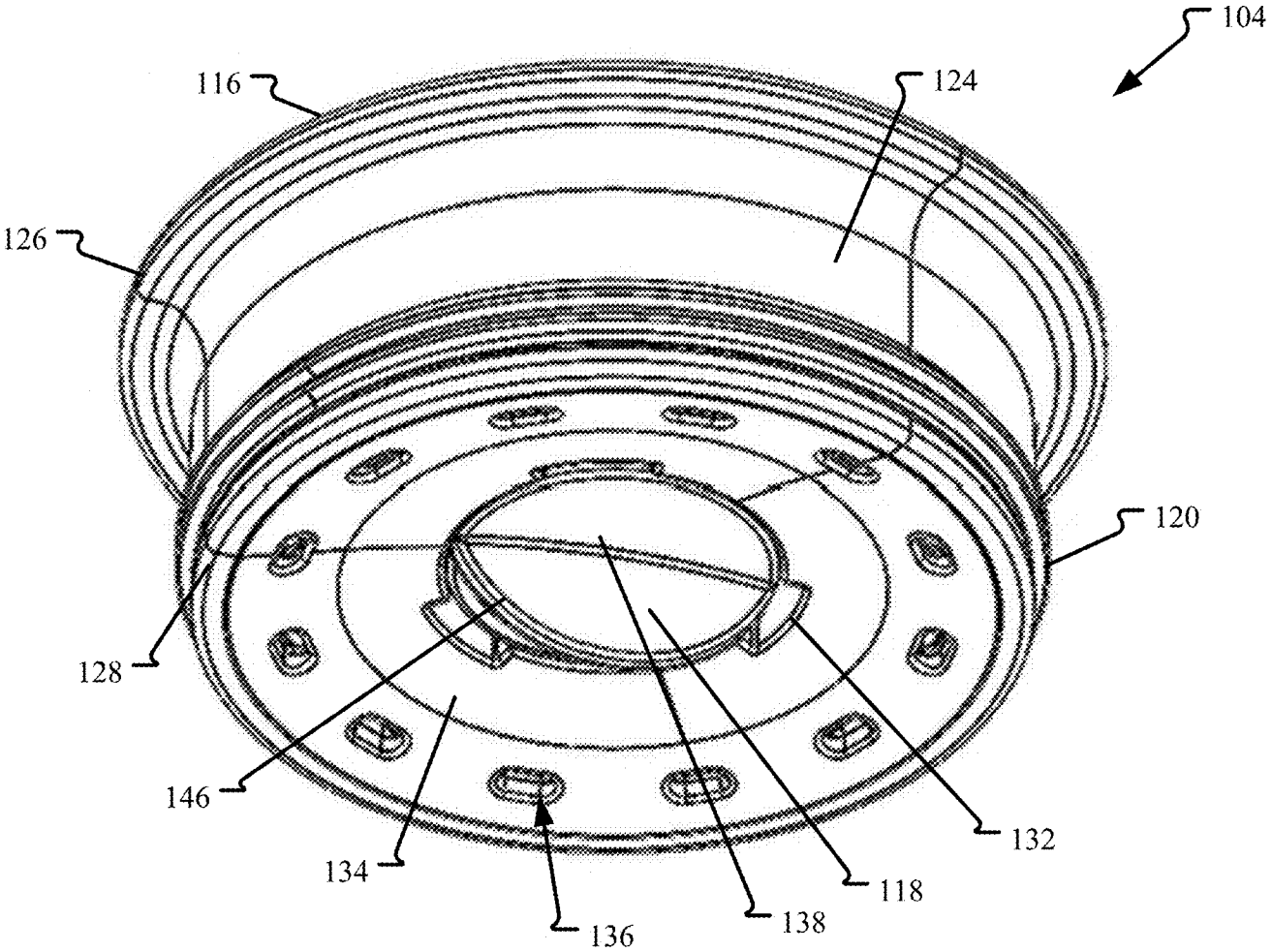
FIG. 4 illustrates a bottom perspective view of the container lid shown in FIGS. 1 and 2.

FIG. 3 illustrates a top perspective view of the container lid 104. FIG. 4 illustrates a bottom perspective view of the container lid 104. Referring concurrently to FIGS. 3 and 4, the container lid 104 may be formed as a two-piece component with the lid body 116 and the lid upper 118. Additionally, the seal 120 may be supported on the lid body 116. The lid body 116 includes an outer perimeter wall 124 having a first end 126 and an opposite second end 128. The first end 126 and the second end 128 define a longitudinal axis 130 of the lid 104. In the example, the outer perimeter wall 124 is substantially cylindrical in shape and forms an outer side wall of the lid body 116. The first end 126 of the outer perimeter wall 124 is flared outward relative to the longitudinal axis 130. The flare may have a curved shaped with the diameter of the outer perimeter wall 124 increasing until the distal end of the outer perimeter wall 124 is reached. In other examples, the flare may have an oblique shape (e.g., a linear shape) as required or desired.

In operation, the upper end portion 106 of the container body 102 (both shown in FIG. 1) is configured to receive the second end 128 of the outer perimeter wall 124 and so that the seal 120 engages with the container body 102. The flared first end 126 of the outer perimeter wall 124 may at least partially cover the upper end portion 106 of the container body 102. In an aspect, the flared first end 126 may radially project from an outer perimeter surface of the container body 102. In another aspect, the flared first end 126 may be substantially flush with the outer perimeter surface of the container body 102. The flared first end 126 may assist in removal of the lid 104 from the container body 102 and may help guide liquid flow through the lid 104 and into the user's mouth.

The lid body 116 also includes an inner structure 132 that is disposed within the outer perimeter wall 124. The inner structure 132 is connected to the outer perimeter wall 124 with a well wall 134 that extends therebetween and that, in example, may be substantially convex in shape. In the example, the well wall 134 extends from the second end 128 of the outer perimeter wall 124. The well wall 134 at least partially defines a plurality of openings 136. The openings 136 may be spaced circumferentially around the longitudinal axis 130 and form a portion of the liquid flow path 114 through the lid 104. For example, the openings 136 may form an inlet for liquid to flow from the container body 102 into the lid 104.

The lid upper 118 includes a lid base 138 that is configured to releasably secure to the inner structure 132 of the lid body 116, as well as a lid roof 140. The lid roof 140 secures to the lid base 138. The lid roof 140 at least partially covers the openings 136 so that the liquid flow path 114 through the lid 104 is not a linear pathway. Rather, the liquid flowing through the liquid flow path 114 must make one or more turns in order to be discharged from the lid 104. The lid roof 140 is spaced from an inner surface 142 of the outer perimeter wall 124 such that a gap 144 is formed therebetween. The gap 144 may form an outlet for liquid to flow out of the lid 104. In the example, the gap 144 fully extends circumferentially around the longitudinal axis 130.

The lid base 138 includes a thumbturn 146 that is accessible from the second end 128 of the lid body 116 when the lid upper 118 is secured thereto. The thumbturn 146 is configured so that the user can easily detach the lid upper 118 from the lid body 116 for cleaning. The thumbturn 146 is described further below.

Figure 5:
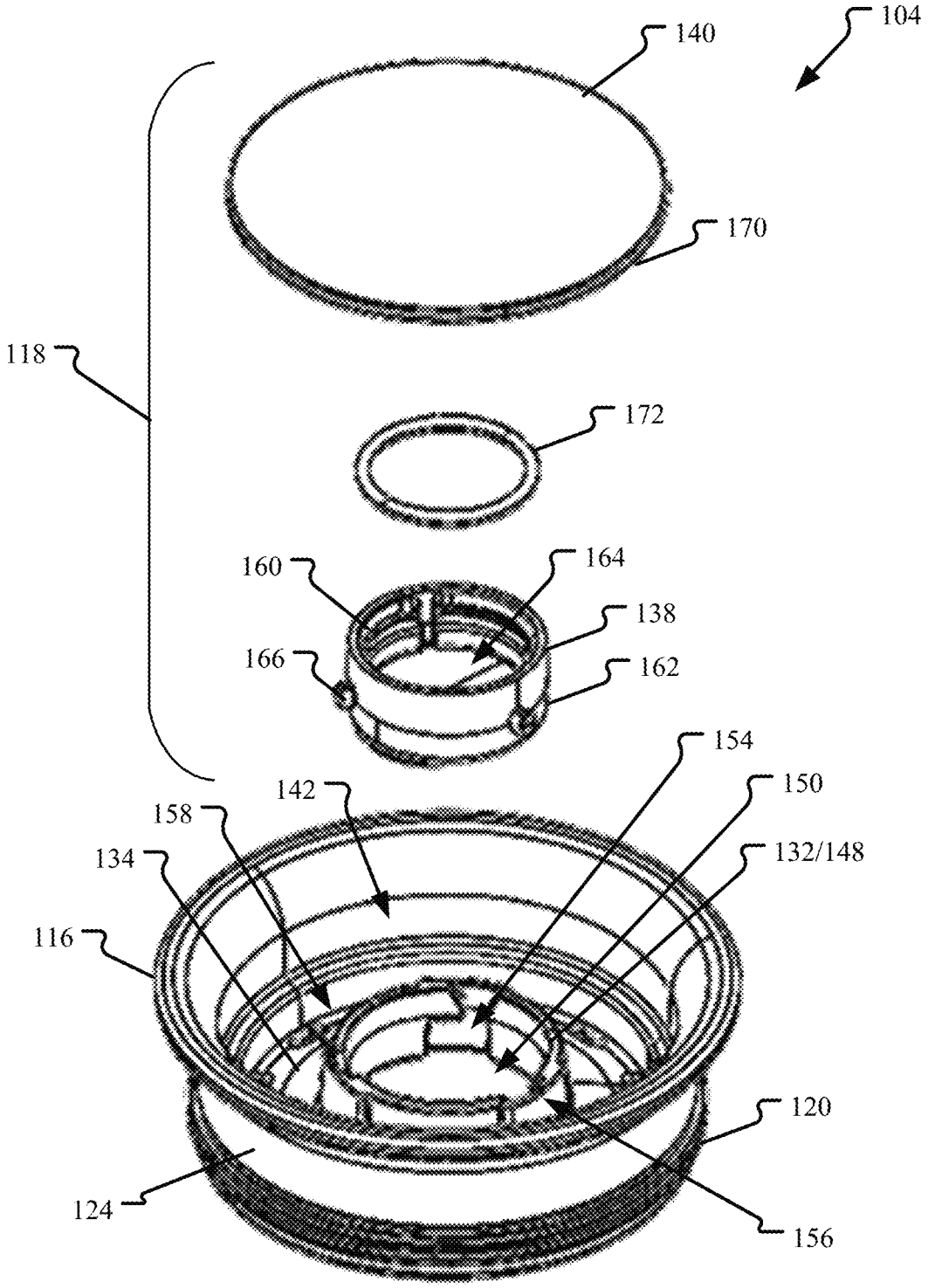
FIG. 5 illustrates a top exploded, perspective view of the container lid shown in FIGS. 1 and 2.
Figure 6:
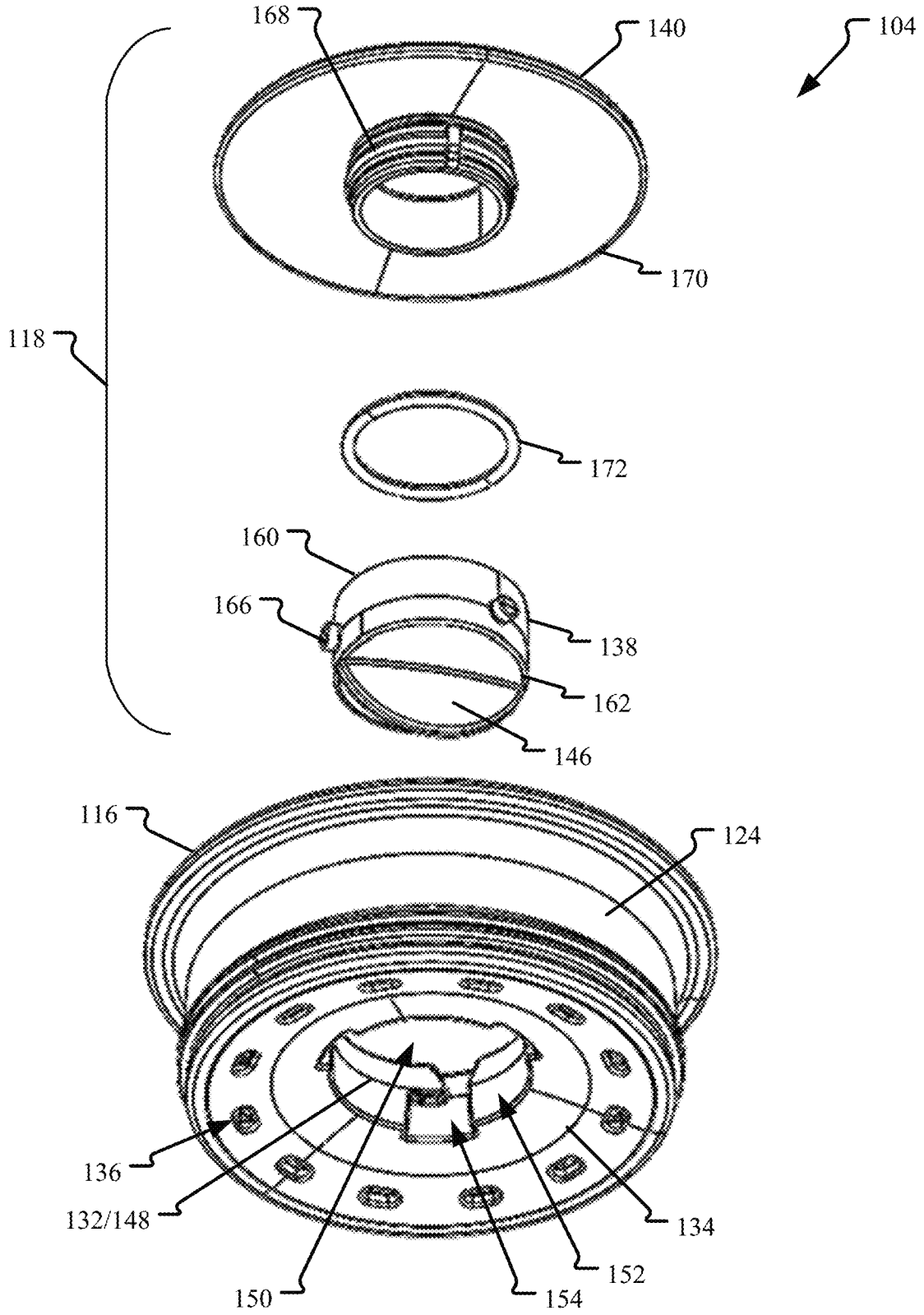
FIG. 6 illustrates a bottom exploded, perspective view of the container lid shown in FIGS. 1 and 2.

FIG. 5 illustrates a top exploded, perspective view of the container lid 104. FIG. 6 illustrates a bottom exploded, perspective view of the container lid 104. Referring concurrently to FIGS. 5 and 6, the container lid 104 includes the lid body 116 and the lid upper 118 which is formed from the lid base 138 and the lid roof 140. The lid body 116 includes the outer perimeter wall 124, the inner structure 132, and the well wall 134. In the example, the lid body 116 may be of unitary construction and the outer perimeter wall 124, the inner structure 132, and the well wall 134 integrally formed. In an aspect, the lid body 116 may be formed from a plastic-based material.

The inner structure 132 defines a central throat 148. The central throat 148 is substantially cylindrical in shape and extends in an upwards direction from the well wall 134. The central throat 148 defines an aperture 150 that extends through the lid body 116. In an example, the central throat 148 is centered within the lid body 116 and aligned with the longitudinal axis 130 (shown in FIG. 3). The central throat 148 has an inner circumferential surface 152 with one or more locking channels 154 defined therein. In the example, three locking channels 154 are defined within the inner surface 152 and circumferentially spaced therearound. An outer circumferential surface 156 of the central throat 148 is radially spaced from the inner surface 142 of the outer perimeter wall 124. Within the lid body 116, the inner surface 142 of the outer perimeter wall 124, the well wall 134, and the outer surface 156 of the central throat 148 at least partially define a perimeter well 158 that extends radially outward from the central throat 148. The perimeter well 158 has the plurality of openings 136 disposed around the central throat 148.

The lid upper 118 includes the lid base 138 and the lid roof 140. The lid base 138 has a top end 160 and an opposite bottom end 162. The bottom end 162 has the thumbturn 146 extending therefrom. In the example, the thumbturn 146 may be a tab that extends at least partially across the bottom end 162 and is configured to enable a user to grasp and turn the lid upper 118 as described herein. The top end 160 of the lid base 138 is configured to receive at least a portion of the lid roof 140. In the example, the lid base 138 is substantially cylindrical in shape with a recess 164 that receives a portion of the lid roof 140. The lid base 138 also includes a plurality of bayonets 166 that are shaped and sized to be received at least partially within a respective locking channel 154 of the central throat 148. In an aspect, the bayonets 166 each may be a cylindrical projection extending radially from the outer surface of the lid base 138. In other examples, the lid base 138 may include the locking channels, while the central throat 148 includes the bayonets 166 and so that the connection structure is reversed.

Figure 8:
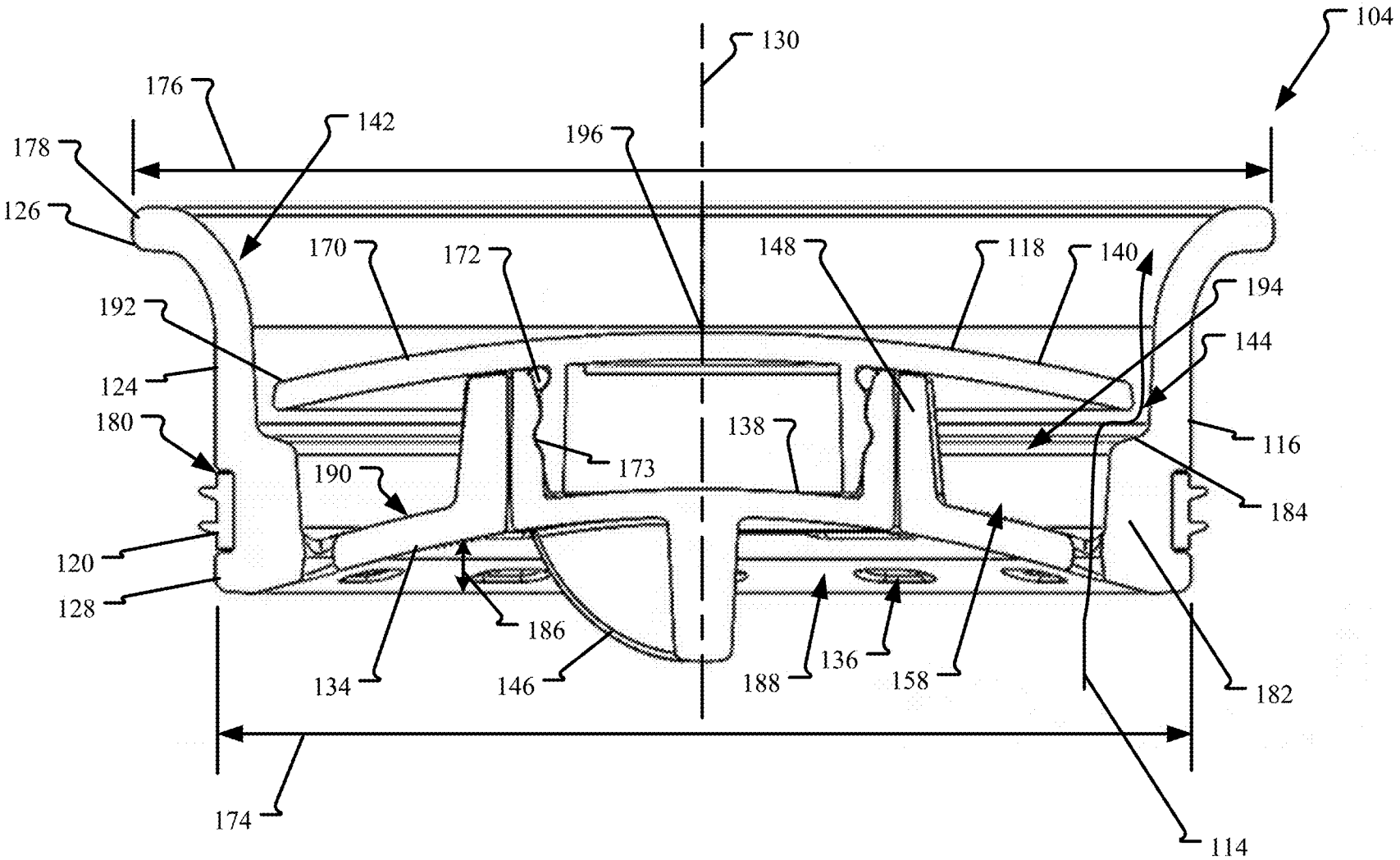
FIG. 8 illustrates a cross-sectional view of the container lid taken along line 8-8 of FIG. 7.

The lid roof 140 includes a bottom cylindrical wall 168 with a top cover 170. The cover 170 is enlarged relative to the bottom cylindrical wall 168 and extends substantially radially outward. A gasket 172 may be disposed between the lid roof 140 and the lid base 138 when the lid upper 118 is assembled. In an example, the gasket 172 may be disposed between the top end 160 of the lid base 138 within the recess 164 and the bottom cylindrical wall 168 of the lid roof 140 and as shown in FIG. 8.

In the example, lid upper 118 is formed as an assembly of the lid base 138 and the lid roof 140. The lid base 138 may be coupled to the lid roof 140 in such a manner that once connected together, the lid base 138 is secured to the lid roof 140 without being removable or not being removable without damage to the components. In an aspect, the lid base 138 may be ultrasonically welded to the lid roof 140. In another aspect, the lid base 138 may be snap-fit or press-fit to the lid roof 140. In still another aspect, the lid base 138 may be threaded onto the lid roof 140. In yet another aspect, the lid base 138 may be unitarily formed with the lid roof 140 (e.g., via an additive manufacturing process or a molding process). In the example, the outer surface of the bottom cylindrical wall 168 of the lid roof 140 and the inner surface of the recess 164 of the lid base 138 can include one or more ribs 173 (shown in FIG. 8) that facilitate securement between the lid roof 140 and the lid base 138. In an aspect, the one or more ribs 173 are not threads.

Figure 7:
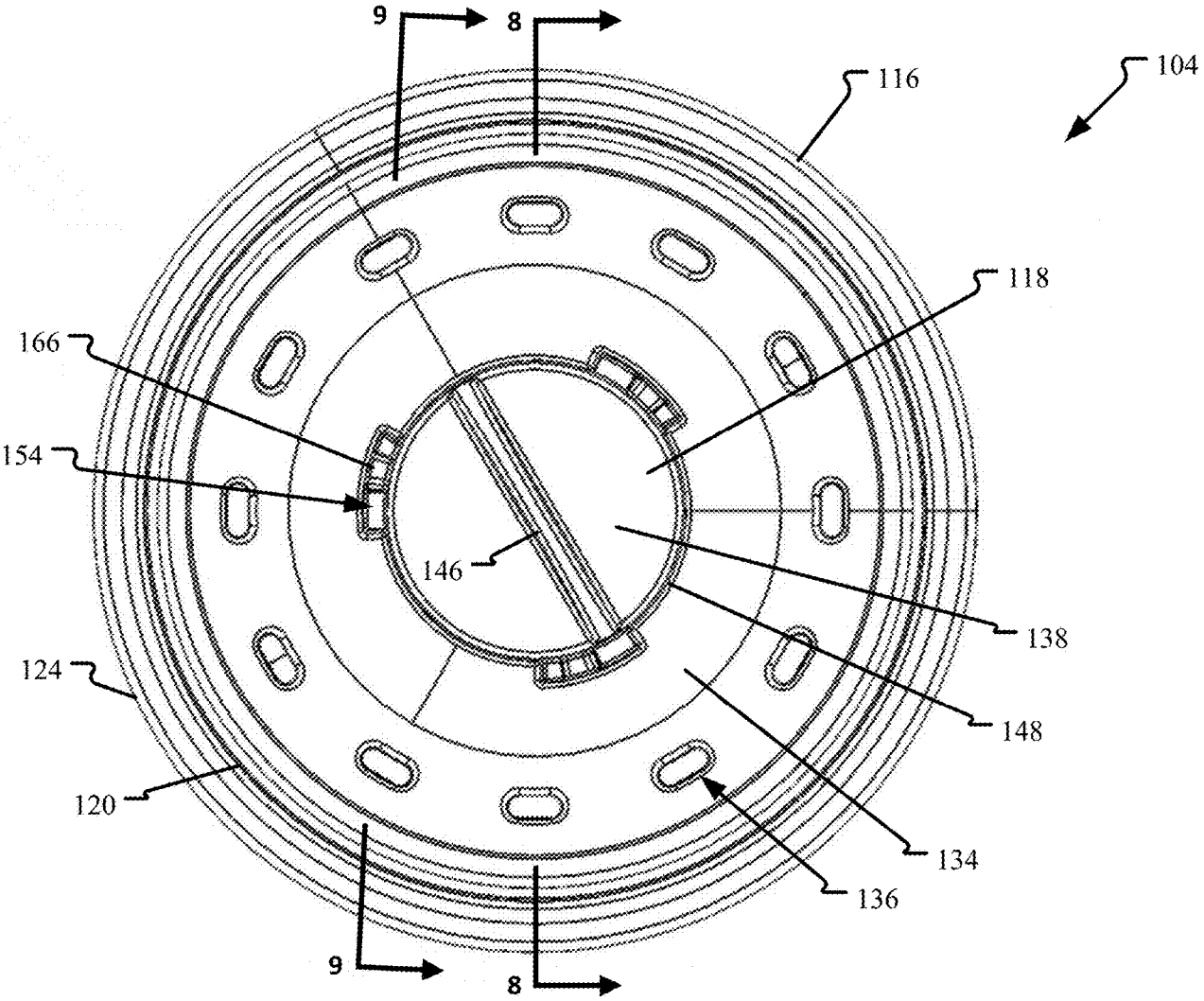
FIG. 7 illustrates a bottom plan view of the container lid shown in FIGS. 1 and 2.

FIG. 7 illustrates a bottom plan view of the container lid 104. As illustrated, the lid upper 118 is coupled to the lid body 116. More specifically, the lid base 138 is received within the central throat 148 such that the bayonets 166 are received at least partially within the locking channels 154. This lockably secures the lid base 138 within the central throat 148 during use of the lid 104, but allows the user to release the lid upper 118 from the lid body 116 and remove the lid upper 118 to facilitate cleaning. To release the lid upper 118, the lid upper 118 can be rotated around the longitudinal axis 130 (shown in FIG. 3) via the thumbturn 146.

Also illustrated in FIG. 7, the outer perimeter wall 124 is shown with the first end flaring radially outward. At the second end of the outer perimeter wall 124, the seal 120 at least partially radially projects for engagement with the container body. The well wall 134 extends between the outer perimeter wall 124 and the central throat 148. The openings 136 form an inlet for fluids into the lid 104. The lid roof 140 (shown in FIG. 6) of the lid upper 118 is disposed on the opposite side of the well wall 134, the lid roof 140 is configured to cover the openings 136 so that the liquid flow path 114 (shown in FIG. 3) is not a straight linear path from the openings 136.

FIG. 8 illustrates a cross-sectional view of the container lid 104 taken along line 8-8 of FIG. 7. Some components are described above and are not necessary described further. The lid body 116 has the first end 126 and the second end 128 of the outer perimeter wall 124 extending along the longitudinal axis 130. The second end 128 has an outer diameter 174 that is smaller than an outer diameter 176 of the first end 126 because the first end 126 flares radially outward. As such, the first end 126 has a distal lip 178 that projects radially outward at the first end 126. Proximate the second end 128 the outer surface of the outer perimeter wall 124, an annular channel 180 is defined that the seal 120 sits at least partially within. The perimeter well 158 is defined between the outer perimeter wall 124, the well wall 134, and the central throat 148.

The inner surface 142 of the outer perimeter wall 124 has a shoulder 182 formed at the second end 128 and the shoulder 182 defines a shelf 184 that extends in a radial direction. The shelf 184 projects inward from the outer perimeter wall 124 towards the central throat 148 and into the perimeter well 158, and is disposed between the first end 126 and the second end 128. In the example, the shoulder 182 is a portion of the outer perimeter wall 124 that has a thickness (e.g., in a radial direction) that is greater than the thickness of the wall proximate the first end 126. Thus, an inner diameter of the outer perimeter wall 124 at the shoulder 182 and the second end 128 is smaller than an inner diameter of the outer perimeter wall 124 at the first end 126.

The well wall 134 extends between the second end 128 of the outer perimeter wall 124 and the central throat 148 so as to support the central throat 148. In the example, the central throat 148 is spaced from the second end 128 and is offset 186 from the second end 128. This results in an underside surface 188 of the well wall 134 being concave in shape. In an aspect, an apex of the concavity is located about a quarter of the height of the lid body 116 along the longitudinal axis 130. In another aspect, the apex of the concavity is located about a third of the height of the lid body 116.

A bottom surface 190 of the perimeter well 158 (e.g., the opposite surface of the well wall 134 from the underside surface 188) pitches in a downward direction from the central throat 148 towards the outer perimeter wall 124 and the shoulder 182. In aspects, the downward pitch of the bottom surface 190 may be curved or linear as required or desired. In the example, the lower portion of the lid base 138 that the thumbturn 146 extends from, may be shaped to correspond to the concave shape of the well wall 134.

The plurality of openings 136 are defined within the well wall 134 so as to define a fluid inlet into the perimeter well 158. In an aspect, the openings 136 are defined by the lid body 116 proximate a lowermost extent of the perimeter well 158. This configuration allows for liquid within the perimeter well 158 to drain back into the container body when the container body is oriented in a substantially upright position. In an aspect, the openings 136 may be defined partially by the shoulder 182 and partially by the well wall 134. In other aspects, the openings 136 may be fully defined within the well wall 134. In still another aspect, a central axis of each opening 136 is not parallel to the longitudinal axis 130.

As illustrated in FIG. 8, the lid upper 118 is coupled to the lid body 116. As such, the lid base 138 is lockably received in the central throat 148 with the cover 170 of the lid roof 140 disposed at least partially above the central throat 148 and the thumbturn 146 extending below the well wall 134. When the lid upper 118 is coupled to the lid body 116, the lid roof 140 at least partially covers the perimeter well 158. In the example, the cover 170 of the lid roof 140 has an outer perimeter 192 that is the radially outermost extent of the lid roof 140. The outer perimeter 192 may be disposed at least partially above the shelf 184. The shelf 184 is thereby disposed at least partially underneath the lid roof 140. The outer perimeter 192 of the cover 170 has a diameter that is larger than the inner surface diameter of the shoulder 182. As such, the cover 170 of the lid roof 140 at least partially covers the openings 136. In an aspect, the cover 170 of the lid roof 140 completely covers the openings 136. As used herein, covering the openings 136 means that the cover 170 is positioned axially over the openings 136.

The diameter of the outer perimeter 192 of the cover 170 is smaller than the inner surface diameter of the outer perimeter wall 124. As such, the gap 144 between the lid roof 140 and the lid body 116 is formed between the outer perimeter 192 of the cover 170 and the outer perimeter wall 124 and the shoulder 182 of the lid body 116. The gap 144 allows liquid to flow out of the lid 104 from the perimeter well 158. In an aspect, the gap 144 fully extends circumferentially around the longitudinal axis 130. This configuration enables the user to drink from any location around the first end 126 of the lid body 116.

When the lid upper 118 is secured to the lid body 116, the cover 170 of the lid roof 140 is axially separated from the well wall 134 such that a splash chamber 194 is defined therein. The splash chamber 194 is a volume at least partially within the lid 104 which makes it difficult for liquid to undesirably flow through. In an aspect, the splash chamber 194 is substantially devoid of structure but for its bounding components. The splash chamber 194 may be substantially cylindrical in shape with an axial, a radial, and a circumferential dimension. An inlet to the splash chamber 194 is defined by the openings 136 and an outlet for the splash chamber 194 is defined by the gap 144 between the lid roof 140 and the outer perimeter wall 124. In an aspect, the splash chamber 194 fully extends circumferentially around the longitudinal axis 130. The openings 136 and the gap 144 are positioned relative to one another such that the liquid flow path 114 that the liquid travels through the splash chamber 194 includes one or more curves. In an aspect, the liquid flow path 114 is not linear or substantially linear. For example, the liquid flow path 114 is forced to make a turn around the outer perimeter 192 of the cover 170 and the shelf 184 of the shoulder 182.

In operation, when liquid within the container body 102 (shown in FIGS. 1 and 2) splashes around and travels through one or more of the openings 136, the liquid flow path 114 is shaped such that the liquid is reduced or prevented from traveling through the gap 144 and out of the lid 104. Instead, the liquid is captured within the splash chamber 194, and then is allowed to drain back into the container body 102, via the openings 136 and when the container body 102 is positioned upright. However, when a user is purposefully drinking from the container and tipping the lid 104 in a drinking configuration, liquid may flow through along the inner surface 142 of the outer perimeter wall 124 and through the splash chamber 194 more smoothly and exit out of the gap 144. Both the openings 136 and the gap 144 are positioned on a radially outward end of the splash chamber 194, but the openings 136 and the gap 144 are not axially aligned along the longitudinal axis 130. Because the openings 136 and gap 144 extend circumferentially around the longitudinal axis 130, air may enter into the container body during drinking so that the liquid flow through the liquid flow path 114 is relatively smooth and consistent. In an aspect, the edges of the shelf 184 may be rounded. In another aspect, the underside of the cover 170 of the lid roof 140 is concave and may correspond the shaped of the well wall 134. The liquid flow path 114 is always open within the lid 104 and neither the openings 136 nor the gap 144 have any covers (e.g., a pivoting or sliding cover) that cover them. As such, it is the structural configuration of the lid 104 that provides for the splash resistant functionality as described herein and not user moveable covers of the liquid flow path.

In the example, the upperside of the cover 170 may be convex. When the lid upper 118 is coupled to the lid body 116, an apex 196 of the lid roof 140 is disposed below the upper extend of the first end 126 of the lid body 116. This configuration allows for liquid not consumed by the user when drinking to also drain back into the container body 102. In an aspect, the apex 196 is aligned with the start of the flaring of the first end 126 of the outer perimeter wall 124. In another aspect, the apex 196 is disposed within the upper half of the lid body 116. In still another example, the apex 196 is disposed within the upper third of the lid body 116.

Figure 9:
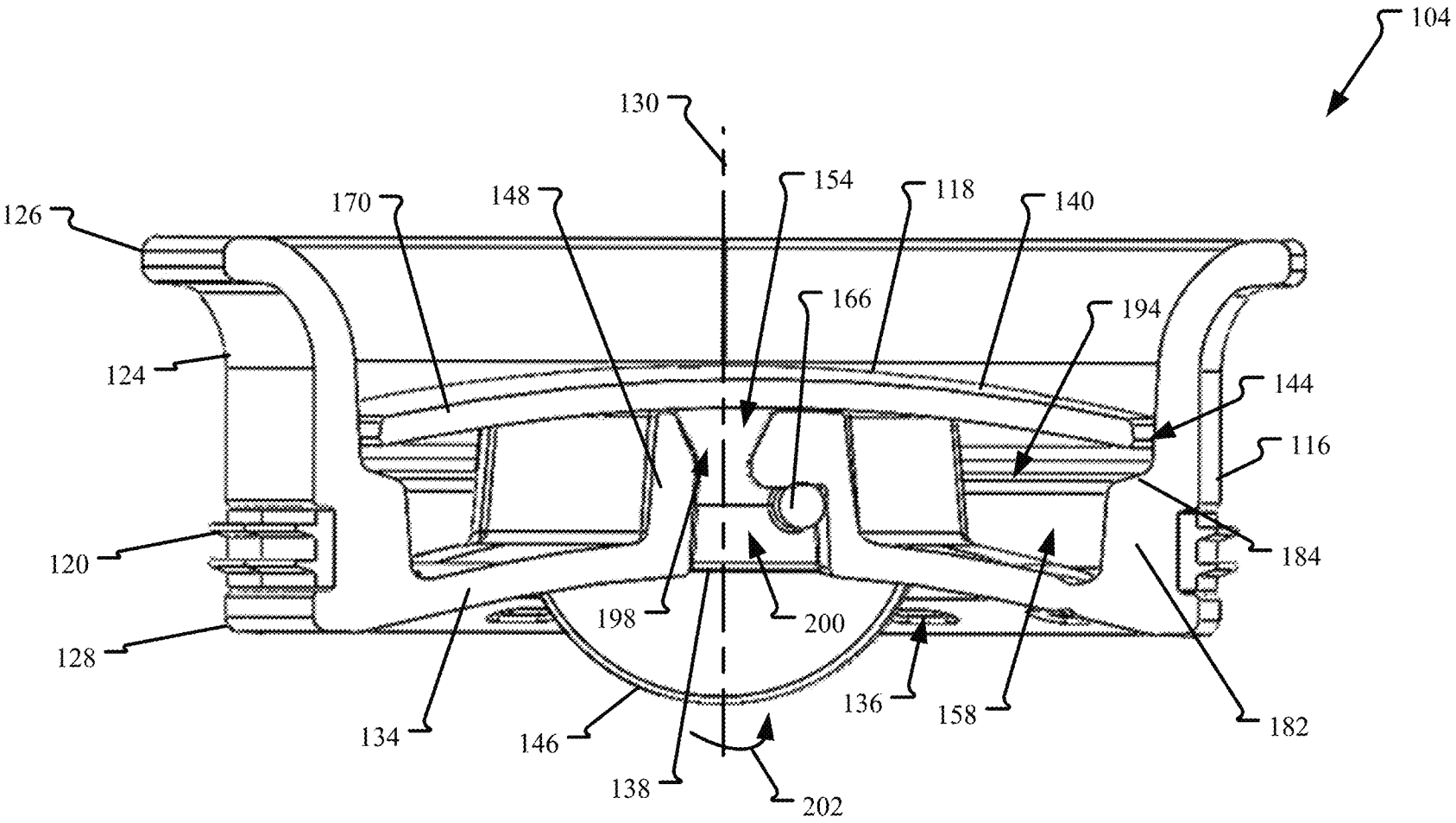
FIG. 9 illustrates a cross-sectional view of the container lid taken along line 9-9 of FIG. 7.

FIG. 9 illustrates a cross-sectional view of the container lid 104 taken along line 9-9 of FIG. 7. Some components are described above and are not necessary described further. While the splash chamber 194 assists in reducing or preventing liquids from undesirably flowing through the lid 104, the splash chamber 194 also makes it difficult to clean the lid 104. As such, the lid upper 118 is configured to be removable from the lid body 116 in order to facilitate cleaning. As described above, the lid base 138 is lockably received at least partially within the central throat 148 so as to securely couple the lid upper 118 to the lid body 116, while still enabling the lid upper 118 to be decoupled as required or desired.

In the example, the lid base 138 lockably mates with the central throat 148 via a bayonet connection. The locking channels 154 defined within the central throat 148 include an axial component 198 and a circumferential component 200. The locking channels 154 are configured to receive the bayonets 166 projecting from the lid base 138. The lid base 138 of the lid upper 118 having the bayonet 166 is configured to be axially inserted into the axial component 198. For example, the lid base 138 can be inserted from the top end of the central throat 148. Once the bayonet 166 is positioned within the circumferential component 200, the lid upper 118 is at least partially rotatable 202 around the longitudinal axis 130 to lock the bayonet connection and position the bayonet 166 so as to be captured below a notch formed within the locking channel 154. In order to unlock the bayonet connection and remove the lid upper 118 from the lid body 116, the coupling steps are reversed. In an aspect, the open end of the axial component 198 may include tapered sides to help capture the bayonet 166.

It is appreciated that while the bayonet connection is described above, the lid upper 118 may be removably coupled to the lid body 116 via any other connection type that facilitates operation of the lid 104 as described herein. For example, the lid base 138 and central throat 148 may be a threaded connection. In other examples, the lid base 138 may couple to the central throat 148 via a snap fit or press fit connection. In still other aspects, the lid upper 118 may be unitarily or integral with the lid body 116 such that the lid upper 118 is not removeable from the lid body 116. While cleaning the container lid 104 may be more difficult, the splash proof functionality of the lid 104 is maintained.

The technologies described herein relate to a lid for a beverage container. The lid includes a lid body and a lid upper that are configured to define a liquid flow path therein that is convoluted and restrict or prevent liquids from spilling out of the lid during container movement. Additionally, the lid upper is removably coupled to the lid body so that the lid may be easily disassembled in order to facilitate cleaning.

Many components of the container lid may be referred to as having generally cylindrical, circular, annular, or conical features. Such features may be referred to, or defined by, a circumference, radius, external surface, internal surface, and/or other terms appropriate for defining such features. It should be noted that such features may alternatively be elliptical, polygonal, and the like. As used herein, the terms "axial" and "longitudinal" refer to directions and orientations, which extend substantially parallel to a centerline of the lid. Moreover, the terms "radial" and "radially" refer to directions and orientations, which extend substantially perpendicular to the centerline of the lid. In addition, as used herein, the terms "circumferential" and "circumferentially" refer to directions and orientations, which extend arcuately about the centerline of the lid.

This disclosure describes some examples of the present technology with reference to the accompanying drawings, in which only some of the possible examples were shown. Other aspects can, however, be embodied in many different forms and should not be construed as limited to the examples set forth herein. Rather, these examples were provided so that this disclosure was thorough and complete and fully conveyed the scope of the possible examples to those skilled in the art. Any number of the features of the different examples described herein may be combined into one single example and alternate examples having fewer than or more than all of the features herein described are possible. Further, as used herein and in the claims, the phrase "at least one of element A, element B, or element C" is intended to convey any of: element A, element B, element C, elements A and B, elements A and C, elements B and C, and elements A, B, and C. It is to be understood that terminology employed herein is used for the purpose of describing particular examples only and is not intended to be limiting. It must be noted that, as used in this specification, the singular forms "a," "an," and "the" include plural referents unless the context clearly dictates otherwise. Further, one having skill in the art will understand the degree to which terms such as "about" or "substantially" convey in light of the measurement techniques utilized herein. To the extent such terms may not be clearly defined or understood by one having skill in the art, the terms such as "about" or "substantially" shall mean plus or minus ten percent.

Although specific examples were described herein, the scope of the technology is not limited to those specific examples. One skilled in the art will recognize other examples or improvements that are within the scope of the present technology. Therefore, the specific structure, acts, or media are disclosed only as illustrative examples. Examples according to the technology may also combine elements or components of those that are disclosed in general but not expressly exemplified in combination, unless otherwise stated herein. The scope of the technology is defined by the following claims and any equivalents therein.

The invention claimed is:

1. A container lid comprising:

a lid body comprising a flared perimeter wall, an inner structure, and a perimeter well, wherein the perimeter well is at least partially defined by an inner surface of the flared perimeter wall, the flared perimeter wall having a first end and an opposite second end, the first end and the second end defining a longitudinal axis;

wherein the inner structure defines a central throat, an outer circumferential surface of the central throat being radially spaced from the inner surface of the flared perimeter wall;

wherein the central throat defines an aperture extending through the lid body, and wherein the perimeter well defines a plurality of openings disposed around the central throat;

a lid body seal disposed about the lid body; and a lid upper comprising:

a lid base; and a lid roof secured to the lid base, wherein the lid base is lockably received within the aperture of the central throat, at an inner circumferential surface of the central throat, wherein when the lid base is lockably secured in the aperture of the central throat, the lid roof partially covers the perimeter well, wherein a bottom surface of the perimeter well pitches downward from the inner structure towards the flared perimeter wall, wherein the plurality of openings are defined by the perimeter well proximate a lowermost extent of the perimeter well, wherein the lid body further comprises an inner shelf projecting inward from the flared perimeter wall towards the perimeter well, wherein the lid roof comprises an outer perimeter disposed at least partially above the inner shelf, wherein an underside of the lid roof is concave, wherein an apex of the lid roof is disposed below an upper extent of the lid body, wherein the lid roof is separated from the inner shelf by a gap, the gap fully extending circumferentially around the longitudinal axis, wherein the lid roof is spaced from the well wall such that a splash chamber is defined thereby, the splash chamber fully extending circumferentially around the longitudinal axis, wherein an inlet to the splash chamber is defined by the plurality of openings and an outlet for the splash chamber is defined by the gap, wherein a nonlinear flow path is defined through the splash chamber, and wherein the liquid flow path is always open, and the gap is not covered.

2. The container lid of claim 1, wherein the central throat defines the inner circumferential surface of the aperture defined by the central throat, the inner circumferential surface comprising a plurality of locking channels, and wherein the lid base comprises a plurality of bayonets extending into the plurality of locking channels when the lid base is lockably secured in the central throat.

3. The container lid of claim 2, further comprising a thumbturn extending from a bottom of the lid base.

4. The container lid of claim 1, wherein the lid base is rotatably secured in the central throat.

5. A container lid comprising:

a lid body including:

a substantially cylindrical outer side wall having a first end and an opposite second end, the first end and the second end defining a longitudinal axis;

a central throat disposed within the outer side wall and spaced radially apart therefrom, wherein the central throat defines an aperture extending through the lid body; and a well wall extending between the outer side wall at the second end and the central throat, the well wall at least partially defining a plurality of openings spaced circumferentially around the longitudinal axis; and a lid upper configured to be releasably secured to the lid body, the lid upper including:

a lid base configured to lockably mate within the aperture of the central throat, at an inner circumferential surface of the central throat; and a lid roof coupled to the lid base, the lid roof having a perimeter diameter, wherein when the lid base is secured within the central throat, the perimeter diameter is such that the lid roof partially covers the plurality of openings, wherein the outer side wall includes an inner shelf disposed between the first end and the second end, the inner shelf disposed at least partially underneath the lid roof when the lid upper is secured to the lid body, wherein the lid roof is separated from the inner shelf by a gap, the gap fully extending circumferentially around the longitudinal axis, wherein the central throat is spaced from the second end of the outer side wall such that an underside surface of the well wall is concave, wherein an underside of the lid roof is concave, wherein an apex of the lid roof is disposed below an upper extent of the lid body, wherein the plurality of openings are defined by the well wall proximate a lowermost extent of the well wall, wherein when the lid upper is secured to the lid body, the lid roof is spaced from the well wall such that a splash chamber is defined thereby, the splash chamber fully extends circumferentially around the longitudinal axis, wherein an inlet to the splash chamber is defined by the plurality of openings and an outlet for the splash chamber is defined by the gap, wherein a nonlinear flow path is defined through the splash chamber, and wherein the liquid flow path is always open, and the gap is not covered.

6. The container lid of claim 5, wherein the lid upper further includes a gasket disposed at least partially between the lid base and the lid roof.

7. The container lid of claim 5, wherein the lid base lockably mates with the throat via a bayonet connection at the inner circumferential surface of the central throat.

8. The container lid of claim 7, wherein the lid base includes one or more bayonets and the throat includes one or more corresponding locking channels.

9. The container lid of claim 7, wherein the lid upper is at least partially rotatable around the longitudinal axis to lock the bayonet connection.

10. A beverage container comprising:

a container body; and a container lid, the container lid configured to removable couple to the container body, the container lid including:

a lid body having a flared perimeter wall, the flared perimeter wall having an inner surface, the flared perimeter wall having a first end and an opposite second end, the first end and the second end defining a longitudinal axis;

a central throat disposed within the flared perimeter wall, an outer circumferential surface of the central throat being radially spaced apart from the inner surface of the flared perimeter wall, wherein the central throat defines an aperture extending through the lid body, and a perimeter well extending between the flared perimeter wall and the central throat, the perimeter well at least partially defining a plurality of openings disposed around the central throat, the perimeter well being at least partially defined by the inner surface of the flared perimeter wall;

a seal disposed around an exterior of the lid body, the seal configured to engage with the container body; and a lid upper having a lid base and a lid roof, the lid upper configured to releasably secure to the lid body such that the lid roof partially covers the perimeter well, wherein when the lid upper is secured to the lid body, the lid roof is spaced from the perimeter well such that a splash chamber is defined, the splash chamber fully extending circumferentially around the longitudinal axis, wherein the lid base is configured to lockably mate within the aperture of the central throat, at an inner circumferential surface of the central throat, wherein a bottom surface of the perimeter well pitches downward from the inner structure towards the flared perimeter wall, wherein the plurality of openings are defined by the perimeter well proximate a lowermost extent of the perimeter well, wherein the lid body further comprises an inner shelf projecting inward from the flared perimeter wall towards the perimeter well, wherein the lid roof comprises an outer perimeter disposed at least partially above the inner shelf, wherein an underside of the lid roof is concave, wherein an apex of the lid roof is disposed below an upper extent of the lid body, wherein the lid roof is separated from the inner shelf by a gap, the gap fully extending circumferentially around the longitudinal axis, wherein an inlet to the splash chamber is defined by the plurality of openings and an outlet for the splash chamber is defined by the gap, wherein a nonlinear flow path within the container lid is defined through the plurality of openings and the splash chamber, and wherein the liquid flow path is always open, and the gap is not covered.

* * * * *